United States Patent [19]

Drake

[11] Patent Number: 4,907,739

[45] Date of Patent: Mar. 13, 1990

[54] HEATING METHOD AND APPARATUS

[75] Inventor: Lawrence V. Drake, Buffalo, Minn.

[73] Assignee: Gyp-Crete Corporation, Hamel, Minn.

[21] Appl. No.: 931,682

[22] Filed: Nov. 17, 1986

Related U.S. Application Data

[63] Continuation-in-part of Ser. No. 854,842, Apr. 22, 1986, abandoned.

[51] Int. Cl.[4] ..... F24D 3/00

[52] U.S. Cl. ..... 237/8 C; 236/12.11; 237/69

[58] Field of Search ..... 237/8 C, 8 R, 56, 69; 236/12.1, 12.11, 12.13

[56] References Cited

U.S. PATENT DOCUMENTS

| | | | |
|---|---|---|---|
| 2,560,282 | 7/1951 | Geisseler | 237/8 C |
| 2,781,174 | 2/1957 | Smith | 237/8 |
| 3,848,800 | 11/1974 | Perche . | |
| 4,397,418 | 8/1983 | Johansson et al. | 21/2 |
| 4,566,628 | 1/1986 | Latarius | 237/8 C |

FOREIGN PATENT DOCUMENTS

| | | | |
|---|---|---|---|
| 2246790 | 4/1973 | Fed. Rep. of Germany . | |
| 2657803 | 1/1977 | Fed. Rep. of Germany | 237/8 C |
| 2645924 | 4/1978 | Fed. Rep. of Germany . | |
| 3133681 | 3/1983 | Fed. Rep. of Germany . | |
| 2085881 | 12/1971 | France . | |
| 101502 | 10/1960 | Norway | 237/8 C |

OTHER PUBLICATIONS

Davis Energy Group, Inc.: *Hydronic Radiant Floor (HRF) Heating Systems Design and Installation Handbook*, 1985.

*Primary Examiner*—Henry A. Bennett

*Attorney, Agent, or Firm*—James R. Haller; Gregory P. Kaihoi; Mary P. Bauman

[57] ABSTRACT

A radiant heating system especially useful for floor heating is provided with a fluid flow apparatus that includes means for pumping a fluid such as water, a temperature-responsive actuator and a valve positionable within a valve housing in response to measured fluid temperature. The system includes heat transfer means, typically a tube embedded in the floor that receives heated fluid from the flow apparatus which in turn receives fluid at generally a higher temperature from a fluid heating apparatus such as a water boiler. The amount of heated fluid recirculated to the heat transfer means is controlled by the position of the valve in the valve housing.

8 Claims, 9 Drawing Sheets

HEATING METHOD AND APPARATUS

REFERENCE TO RELATED APPLICATIONS

This application is a continuation in part of co-pending application Ser. No. 854,842 filed Apr. 22, 1986 now abandoned.

FIELD OF INVENTION

The invention relates to an environmental heating system that utilizes a flowing heated fluid to transfer heat from a heat source to a selected environment. The invention is directed to a radiant floor heating method and apparatus.

BACKGROUND OF INVENTION

Fluid heating systems, such as hot water heating units, have been used to provide radiant heat to selected spaces. Radiators located in the spaces and tubes located in floors have been used to transfer the heat from the fluid to the air in the surrounding environment. Manually and mechanically operated valves associated with the radiators and tubes are used to control the flow of the heated fluid to the radiators and tubes thereby control the amount of heat that is transferred to the environment. Radiant floor heating systems require technical engineering design for each installation. The variations in the floors and floor coverings require alterations in the heating systems such as fluid delivery temperature and flow rates, as well as the size and spacing of the tubes that carry the heating fluid. The fluid flow controls for radiant heating systems include indoor and outdoor thermostats that control three and four way valves used to regulate the flow of fluid through boilers and heat transfer loops. The heating method and apparatus of the invention overcomes the individual design restrictions of the prior radiant heating systems.

SUMMARY OF INVENTION

The invention is directed to a radiant heating system operable to heat one or more selected areas to desired temperatures. The radiant heating system is embodied in a method and apparatus that utilizes a fluid flow control apparatus for regulating the flow and temperature of fluid to heat transfer means so that heat from the heat transfer means is radiated to the environment in the selected area. The temperature of the fluid being transferred to the heat transfer means is controlled by recirculating a portion of the fluid that is flowing from the heat transfer means back to the heat transfer means. Heated fluid from the fluid heating apparatus is combined with the recirculating fluid and moved to the heat transfer means. The ratio of the heated fluid to the recirculated fluid is controlled in response to the temperature of the fluid being transferred to the heat transfer means. The system automatically adjusts to the environment in which it is installed thereby eliminating specific engineering designs for each installation.

The radiant heating system has a fluid heating apparatus, such as a boiler, operable to heat a fluid. The fluid is preferably a liquid, such as water. The fluid heating apparatus is associated with a pump operable to move the heated fluid to a fluid flow control apparatus. The fluid flow control apparatus has a thermostatically actuated valve that controls the flow of heated fluid to a heat transfer apparatus, such as a loop tubular coil embodied in a floor or other structure, located in the environment to be heated. The control apparatus includes a pump that independently circulates the fluid through the heat transfer apparatus. The control apparatus includes a valve associated with a temperature responsive actuator. The valve operates to control the ratio of the recirculation of fluid in the heat transfer apparatus to the heated fluid from the fluid heating apparatus that is pumped into the heat transfer apparatus. The valve is initially actuated in response to the pumping of fluid to the heat transfer apparatus. Hot fluid from the fluid heating apparatus is initially pumped through the fluid flow control apparatus to the heat transfer apparatus and cool fluid is returned to the fluid heating apparatus. The temperature responsive actuator when subjected to heat will move the valve to a position to allow recirculation of the fluid in the heat transfer apparatus and thereby regulate the temperature of the fluid being pumped to the heat transfer apparatus. The position of the valve is manually adjustable to regulate the maximum temperature of the fluid being transferred to the heat transfer apparatus.

In a preferred embodiment, the fluid flow control apparatus includes a housing having an internal passage and a pump chamber in communication with the internal passage. The housing is of heat insulative material such as plastic so that the housing itself conducts little heat from one fluid stream to another. Desirably, the housing is of a material having a coefficient of thermal conductivity of less than 1.0 kcal/m h °C. The housing preferably includes an outlet passage in communication with the pump chamber for connection to the heat transfer apparatus. The pump chamber includes rotatable means such as an impeller to pump fluid from the internal passage to the outlet passage. A valve body is provided in the internal passage, the body having a valve passage divided into valve chambers within which a valve is movably positioned to provide appropriate fluid recirculation from the heat transfer means to the heat transfer means to regulate the temperature of fluid flowing to the heat transfer means. The valve body preferably has a first valve chamber connected to the heat transfer means to receive fluid therefrom, a second valve chamber connected to the fluid heating means to receive heated fluid therefrom, and a third valve chamber connected to the fluid heating means to return fluid thereto. A valve is positioned in the valve passage operable to control the flow of fluid to and from the fluid heating means and recirculation of fluid from the heat transfer means back to the heat transfer means. A temperature-responsive actuator in the valve housing cooperates with the valve to control the rate of flow of fluid to the fluid heating apparatus and recirculation of fluid to the heat transfer apparatus.

A thermostat may be connected to a switching circuit to energize the pumps for the fluid heating apparatus and the fluid flow control apparatus. A plurality of fluid flow control apparatus can be connected to header tubes leading to and from the fluid heating apparatus. Each fluid flow control apparatus may be controlled by a thermostat located in a selected environment so that the flow of heated fluid as well as the temperature of the fluid is controlled. A heat transfer is fluidly coupled to each fluid flow control apparatus so that the temperature of the separate areas can be independently controlled.

DESCRIPTION OF PREFERRED EMBODIMENTS

Figure 1:
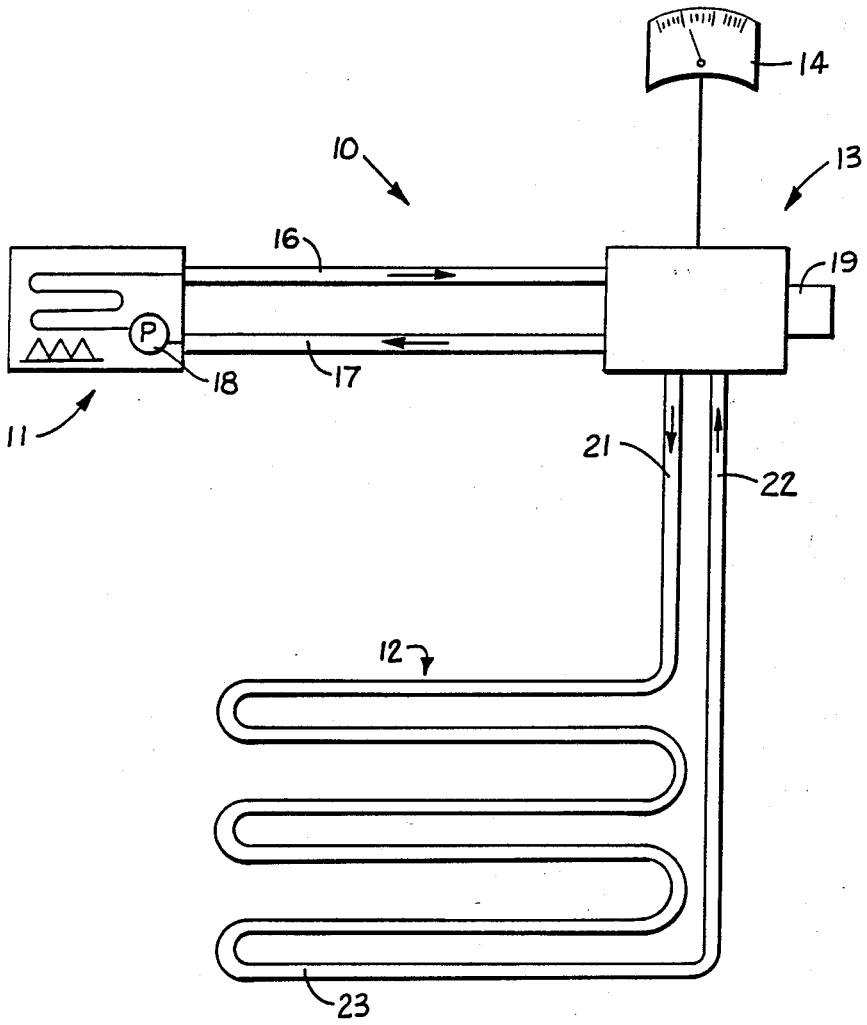
FIG. 1 is a diagrammatic view of a radiant heating system equipped with a fluid flow control apparatus of the invention.

Referring to the drawing, there is shown in FIG. 1, a diagram of the radiant heating system indicated generally at 10 operable to heat a selected environment, such as a room, office, work area, and the like. Heating system 10 includes an apparatus for providing a source of hot fluid, such as water, steam, other liquids and gases. The apparatus can be a boiler equipped with a burner to heat the fluid, a solar collector, and like structures for heating a fluid. A heat transfer apparatus indicated generally at 12 receives the hot fluid from apparatus 11. Heat is transferred from apparatus 12 to the surrounding environment. A fluid flow control apparatus indicated generally at 13 is operable to control the circulation of fluid through heating system 10 to achieve desired temperatures of the environment. A thermostat controller 14 regulates the operation of the fluid control apparatus 13. A pair of fluid carrying lines, such as conduits or pipes 16 and 17 connect fluid heating apparatus 11 to fluid control apparatus 13. A motor driven pump 18 cooperating with apparatus 11 operates to move the fluid through fluid heating apparatus 11 and flow control apparatus 13. Control apparatus 13 has a pump 19 operable to move the fluid through the control apparatus 13 and into tubular members or tubes 21 and 22 connected to a continuous serpentine tube 23 positioned in the environment to transfer heat thereto. Tube 23 can be metal tubes exposed to the air or incorporated into a floor, wall, ceiling, or other parts of a structure. Tube 23 is made of material that efficiently conducts heat. Tube 23 desirably is of polymeric material, and is embedded in concrete, gypsum cement or other flooring material.

Figure 11:
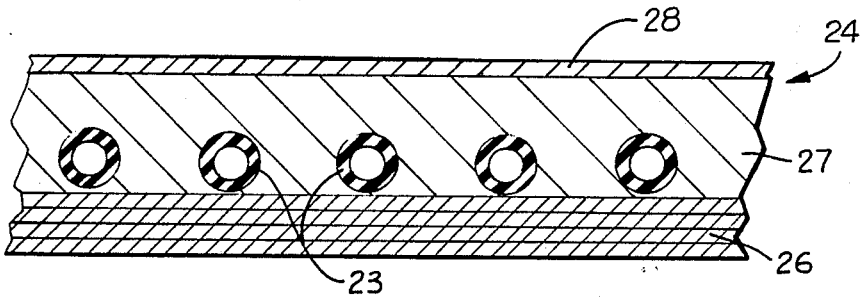
FIG. 11 is a cross-sectional view of one form of a heat transfer apparatus comprising a floor having the heating tubes.
Figure 12:
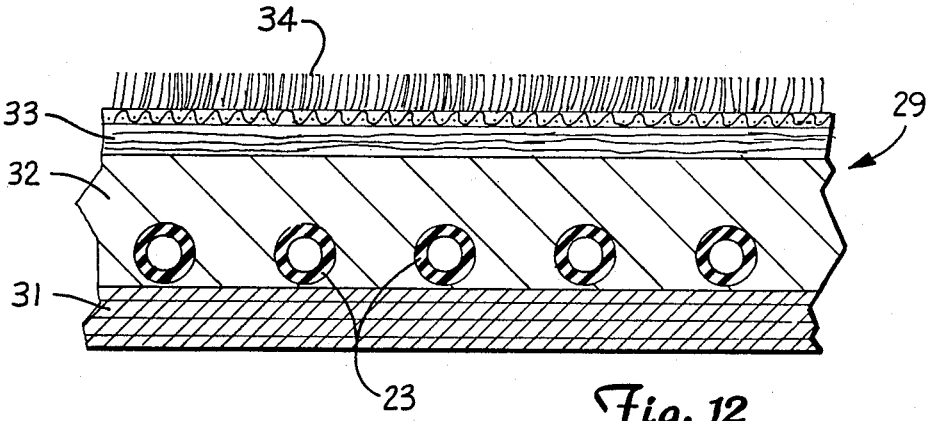
FIG. 12 is a cross-sectional view of another form of a heat transfer apparatus comprising a carpeted floor having heating tubes.

Examples of tubular heat transfer structures are shown in FIGS. 11 and 12. As shown in FIG. 11, a floor indicated generally at 24 has a base 26 of plywood. A slab 27 of concrete and like material is supported on base 26. A cover layer 28 of wood, plastic, ceramic and the like is located over the top of slab 26. Serpentine tube 23 is embedded in slab 27 adjacent base 27. The entire outer surface of the tube 23 is in continuous surface engagement with the material of slab 27. This provides for an effective transfer of heat from the fluid carried by tube 23 to slab 27. Heat is transferred from cover layer 28 to the air and to objects on floor 24. Referring to FIG. 12, there is shown a modification of a floor indicated generally at 29. Floor 29 has a plywood base 31 supporting a slab 32 of concrete or like material. A cushion or mat 33 rests on top of slab 32. A carpet 34 covers the mat 33. Tube 23 is embedded in slab 32 adjacent base 31. The heat of the delivery fluid is transferred through the tube 23 and slab 32 to the surface of the floor. The spacing of the sections of tube 23 from each other is generally constant throughout the floor to provide substantially uniform floor temperature. Spacing of the sections of tube 23 may be closer in areas where higher floor surface temperatures are desired, such as bathrooms, in front of large window areas, entry ways or around perimeters next to outside walls.

Figure 2:
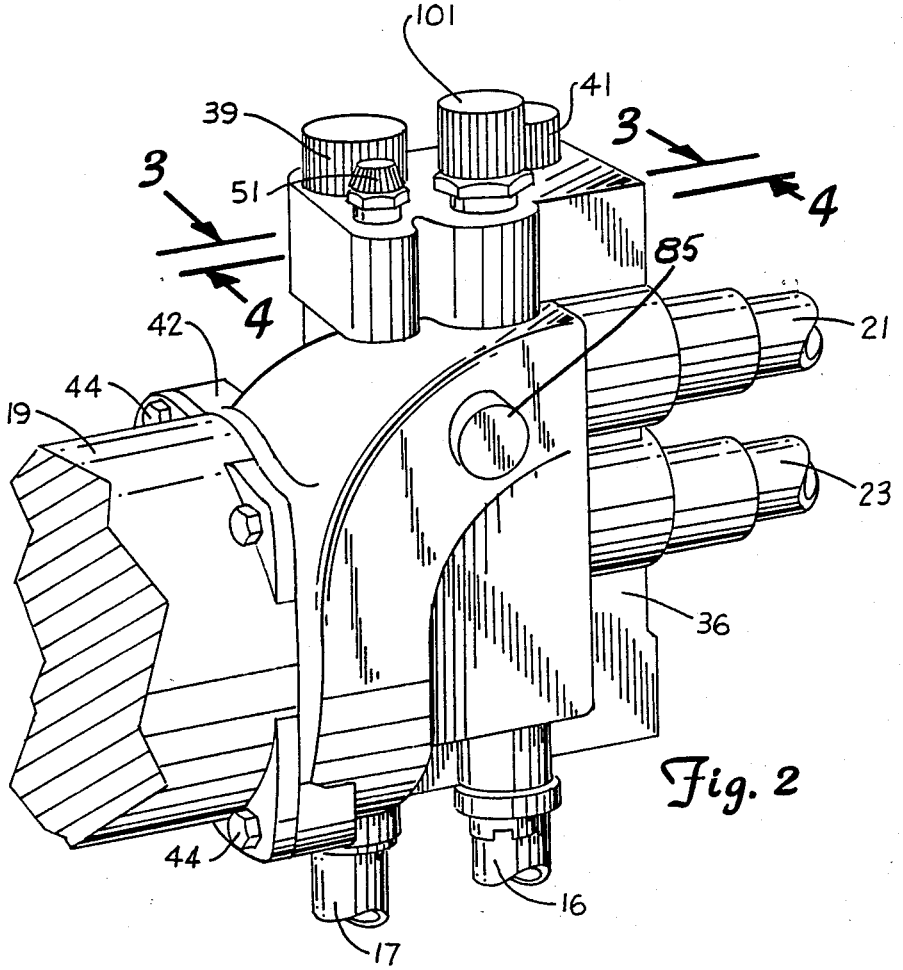
FIG. 2 is a perspective view of the fluid flow control apparatus.
Figure 3:
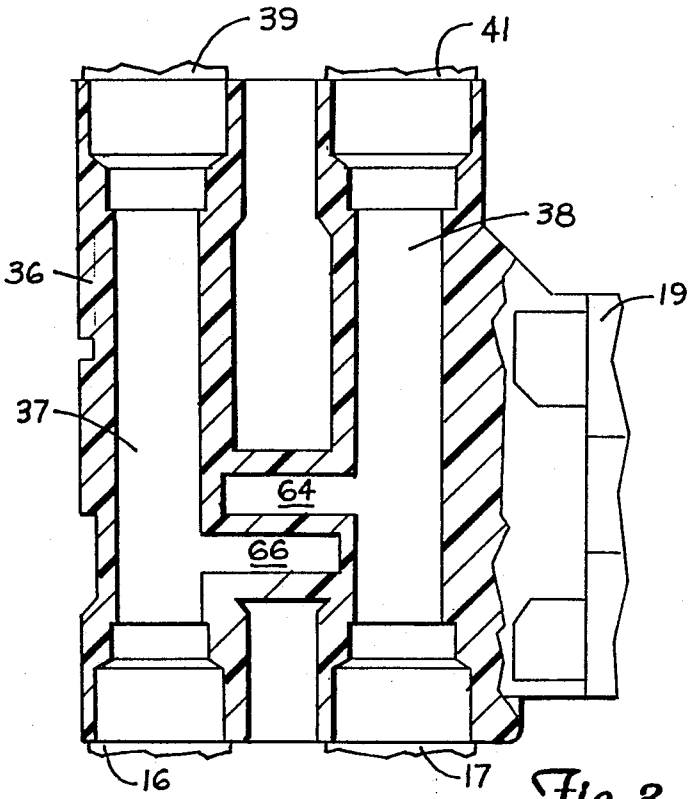
FIG. 3 is a sectional view taken along line 3—3 of FIG. 2.
Figure 4:
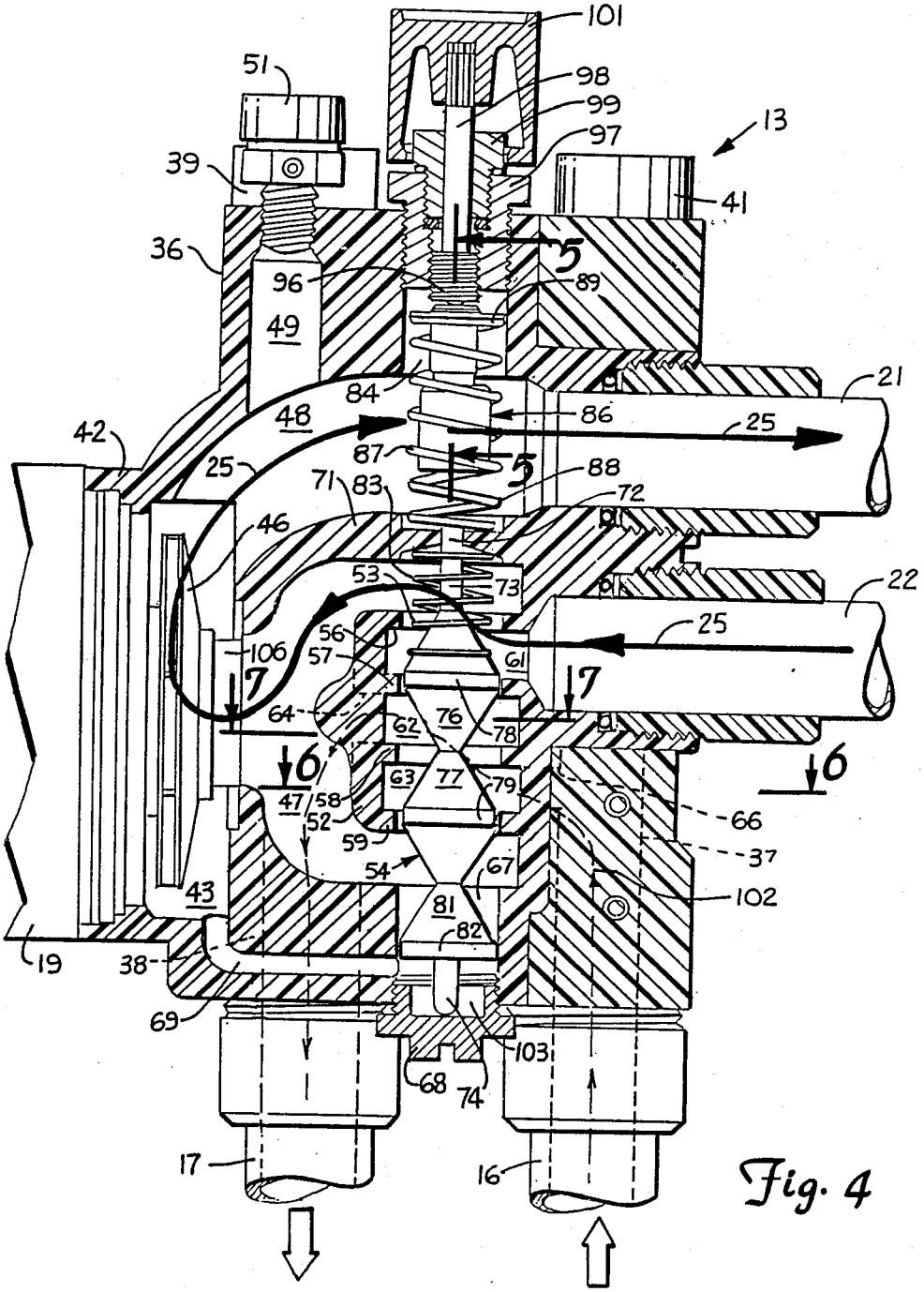
FIG. 4 is an enlarged sectional view taken along the line 4—4 of FIG. 2 showing the valve in a position to recirculate the fluid in the heat transfer apparatus.
Figure 6:
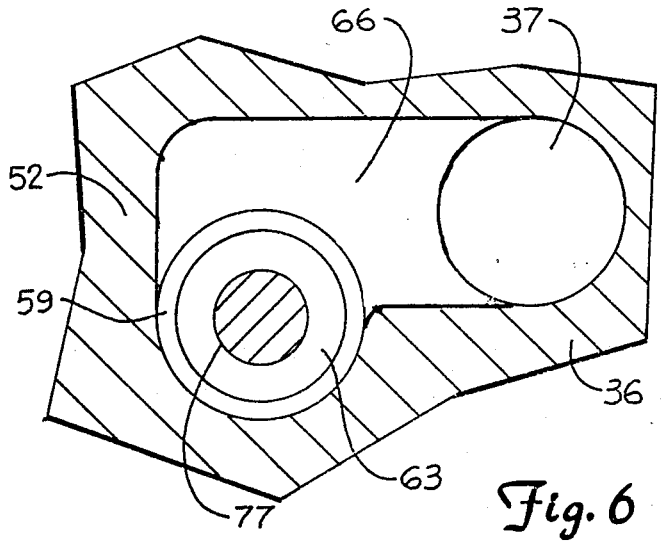
FIG. 6 is a sectional view taken along line 6—6 of FIG. 4.

As shown in FIGS. 2 and 3, fluid control apparatus 13 has a housing or casing 36 having a pair of generally parallel passages 37 and 38. The upper ends of passages 37 and 38 are closed with caps 39 and 41 respectively. Caps 39 and 41 can be removed whereby a plurality of fluid control apparatuses can be connected in series. Housing 36 has a hub 42 defining a pump chamber 43. A plurality of bolts 44 secure pump 19 to hub 42. Pump 19 comprises an electric motor drivably connected to a disc impeller 46. As shown in FIG. 4, impeller 46 is located in pump chamber 43. Impeller 46 has a central sleeve 106 which directs fluid into the impeller. When impeller 46 is rotated, fluid is discharged radially therefrom.

Housing 36 has an internal inlet passage 47 open to the center area of pump chamber 43 and an outlet passage 48 connecting pump chamber 43 with tube 21. A wall 71 separates passages 47 and 48. A bore 49 open to outlet passage 48 is closed with an air bleed valve 51. Valve 51 is manually rotatable to selectively open and close positions whereby the operator can bleed the air from the internal passages and chambers of housing 36.

Figure 7:
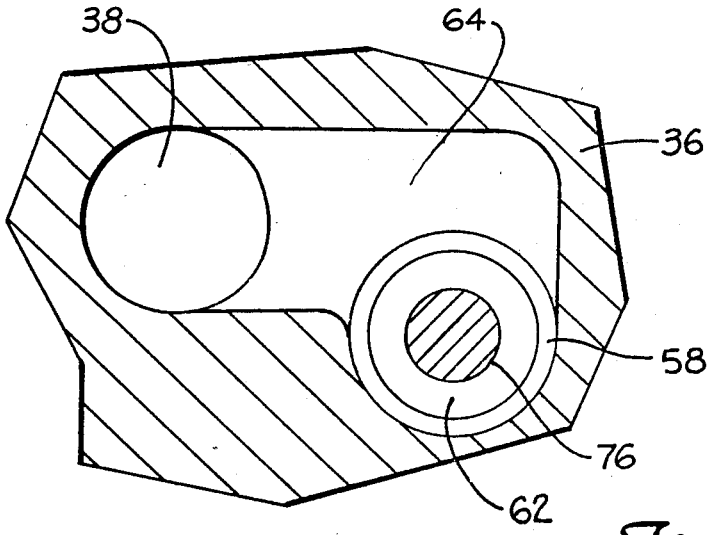
FIG. 7 is a sectional view taken along line 7—7 of FIG. 4.

As shown in FIG. 4, the center position of housing 36 has a valve body 52 located in inlet passage 47. Body 52 has a valve passage 53 accommodating a linearly movable spool valve indicated generally at 54. Body 52 has a plurality of inwardly directed annular ribs 56, 57, 58, and 59 that are axially spaced from each other and form valving chambers 61, 62, and 63. Valving chamber 61 is open to tube 22 and inlet chamber 47. A first lateral passage 64, shown in FIGS. 3, 4, and 7 connects passage 38 with valve chamber 62. As shown in FIG. 3, a second lateral passage 66 connects passage 37 with valve chamber 63. The lower end 67 of passage 53 is closed with a plug 68. A passage 69 in housing 36 connects the lower portion of pump chamber 43 to the bottom of passage 67 whereby fluid under pressure established by rotating impeller 46 is directed to the bottom of passage 67.

Internal wall 71 separating the inlet passage 47 from the outlet passage 48 has a hole 72 accommodating a linear rod 73 of spool valve 54. The lower end of spool valve 54 has a short rod 74 that is located adjacent plug 68. Spool valve 54 has a pair of spools 76 and 77. The spools 76 and 77 each have a double cone shape with outwardly converging outer cone surfaces. Each end section of the spool is a frustum of a right circular cone. The larger outer ends of each cone are joined to annular rims 78 and 79 respectively. Rims 78 and 79 have diameters that are substantially the same as the diameter of valve passage 53 provided by ribs 56, 57, 58, and 59 whereby spool valve 54 has a sliding fit in passage 53. Spool valve 54 is free to rotate about its longitudinal axis to minimize wear and sticking of the valve in body 52. Spool valve 54 has a bottom cone-shape member or piston 81 having an annular rim 82 located in passage 67. A spring 83 located about rod 73 engages wall 71 and upper spool 78 to bias the entire spool valve 54 in a downward direction as viewed in FIG. 4. Spring 83 yieldably holds rod 74 in engagement with plug 68. When spool valve 54 is in its first position, as shown in FIG. 4, passages 64 and 66 are in communication with each other via valve chambers 62 and 63 whereby the fluid is free to circulate in the fluid heating loop comprising fluid heating apparatus 11 and lines 16 and 17 carrying fluid to and from fluid control apparatus 13. The fluid in heat transfer apparatus 12 including the tubes 21 and 22 is free to continuously flow through fluid control apparatus 13 as shown by arrows 25.

A temperature responsive linear actuator indicated generally at 86 is located in outlet passage 48 in alignment with spool valve 54. Actuator 86 is a thermostatic actuator manufactured by Robershaw Controls Company, Knoxville, Tenn. A coil spring 87 retains actuator 86 in longitudinal alignment with valve 54 and continuously biases the actuator 86 to its contracted position. The bottom of coil spring 87 is located within a circular recess 88 in the top of wall 71. The upper end of spring 87 is located in a bore 84 in housing 36. The upper end of spring 87 engages a washer or collar 89 attached to actuator 86. Washer 89 has a diameter smaller than bore 84 to allow it to move and rotate.

Figure 5:
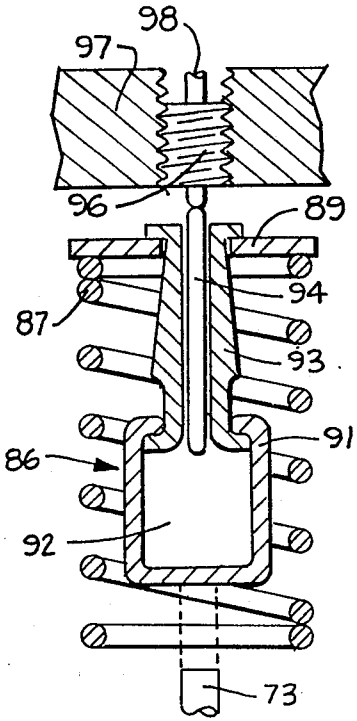
FIG. 5 is an enlarged sectional view taken along line 5—5 of FIG. 4.

Referring to FIG. 5, temperature responsive linear actuator 86 has a hollow casing 91 accommodating a wax and powder material 92. A tubular neck 93 accommodating a movable rod or piston 94 is joined to one end of casing 91. As shown in FIG. 4, stop 96 is threaded into a plug 97 that is turned into a threaded portion of housing 36 forming passage 84. Stop 96 is joined to an upwardly directed rod 98. The rod 98 is rotatably received in a collar 99 threaded into plug 97. A knob 101 attached to the top of rod 98 is used to rotate stop 96 and thereby adjust the linear position of spool valve 54 relative to body 52. This adjustment is used to regulate the mixing of flows to obtain a set water temperature to the heat transfer apparatus 12.

The valve housing and preferably the valve body are made of a material having a coefficient of thermal conductivity less than 1.0 kcal/m h °C., and preferably is of a temperature resistant plastic. A thermosetting polyester casting resin sold, under the trademark Atlac 580 by ICI Americas, Inc., has given good results. The housing and valve body may be molded in several parts that are later assembled, or can be molded as a unitary structure utilizing a meltable wax core to define the various internal passageways, the wax being melted from the housing and valve body once the latter have been hardened. Although the housing and preferably the valve body are of heat insulative material, as described, other value components of lesser size and mass, such as the bleed valve 51, the linear actuator 86, and parts such as the thermocouple part 85 may be of metal.

Figure 10:
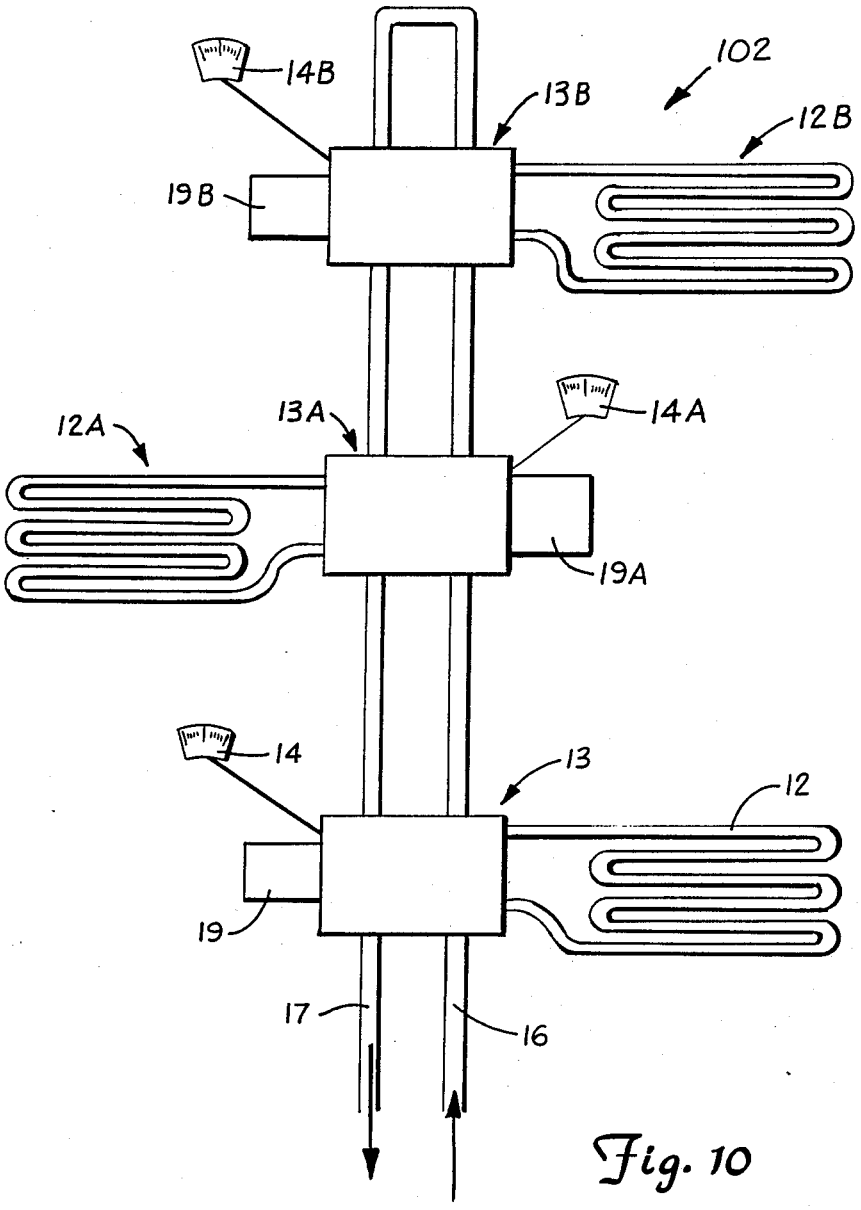
FIG. 10 is a modification of the radiant heating system having a plurality of fluid flow control apparatuses of the invention.

Referring to FIG. 10, there is shown a radiant heating system indicated generally at 102 comprising a plurality of fluid flow control apparatuses 13, 13A, and 33B. Additional fluid control apparatus and heat transfer apparatuses can be included in the heating system. The apparatuses are identical in structure and operation to the fluid control apparatus 13. Apparatus 13 is coupled in fluid flow relation to heat transfer apparatus 12. In a similar manner, apparatus 13A is coupled in fluid flow relation to heat transfer apparatus 12A. Fluid control apparatus 13B is coupled in fluid flow relation to heat transfer apparatus 12B. Each fluid control apparatus 13, 13A, and 13B may have an independent thermostatic controller, 14, 14A, and 14B. Pumps 19, 19A, and 19B are associated with each of the fluid control apparatuses 13, 13A, and 13B respectively. The fluid control apparatuses 13, 13A, and 13B are connected in series to the hot fluid supply line 16 and the return fluid line 17. Lines 16 and 17 are connected to a fluid heating source (not shown), such as apparatus 11. Each of the fluid control apparatuses 13, 13A, and 13B is independently operable to control the flow of hot fluid to heat transfer apparatuses 12, 12A, and 12B. The fluid control apparatuses of the heating system can be connected in parallel with suitable fluid carrying lines. Each control apparatus 13, 13A, and 13B can be adjusted to provide the desired fluid temperature to a zone or environment. This temperature is independent of the fluid temperature that the fluid heating apparatus is producing or the fluid temperature the other heat transfer apparatuses for the zones.

In use, when the heating system 10 is off, spool valve 54, which may be of brass or other metal, or of plastic or other material, is in its first or lower position as shown in FIG. 4. Spring 83 biases spool valve 54 into its first position wherein rims 78 and 79 of spool 76 and 77 are aligned with annular ribs 57 and 59. The fluid in the heating loop including lines 16 and 17 is free to circulate through valve chambers 62 and 63 as shown by the broken line 102. This circulation is caused by the pump 18 in fluid heating apparatus 11. Spool 76 is spaced below the top opening of valve passage 53 so that the fluid in return line 22 can flow through inlet passage 47 to pump chamber 43. The fluid is free to flow into outlet passage 48 and outlet tube 21 leading to serpentine tubes 23 of heat transfer apparatus 12. The temperature responsive linear actuator 86 is biased by spring 87 to its contracted position as it is not responsive to the cool temperature of the fluid being moved through the outlet passage 48. The spool valve 54 will remain in the first position as long as motor 19 is inoperative.

Figure 8:
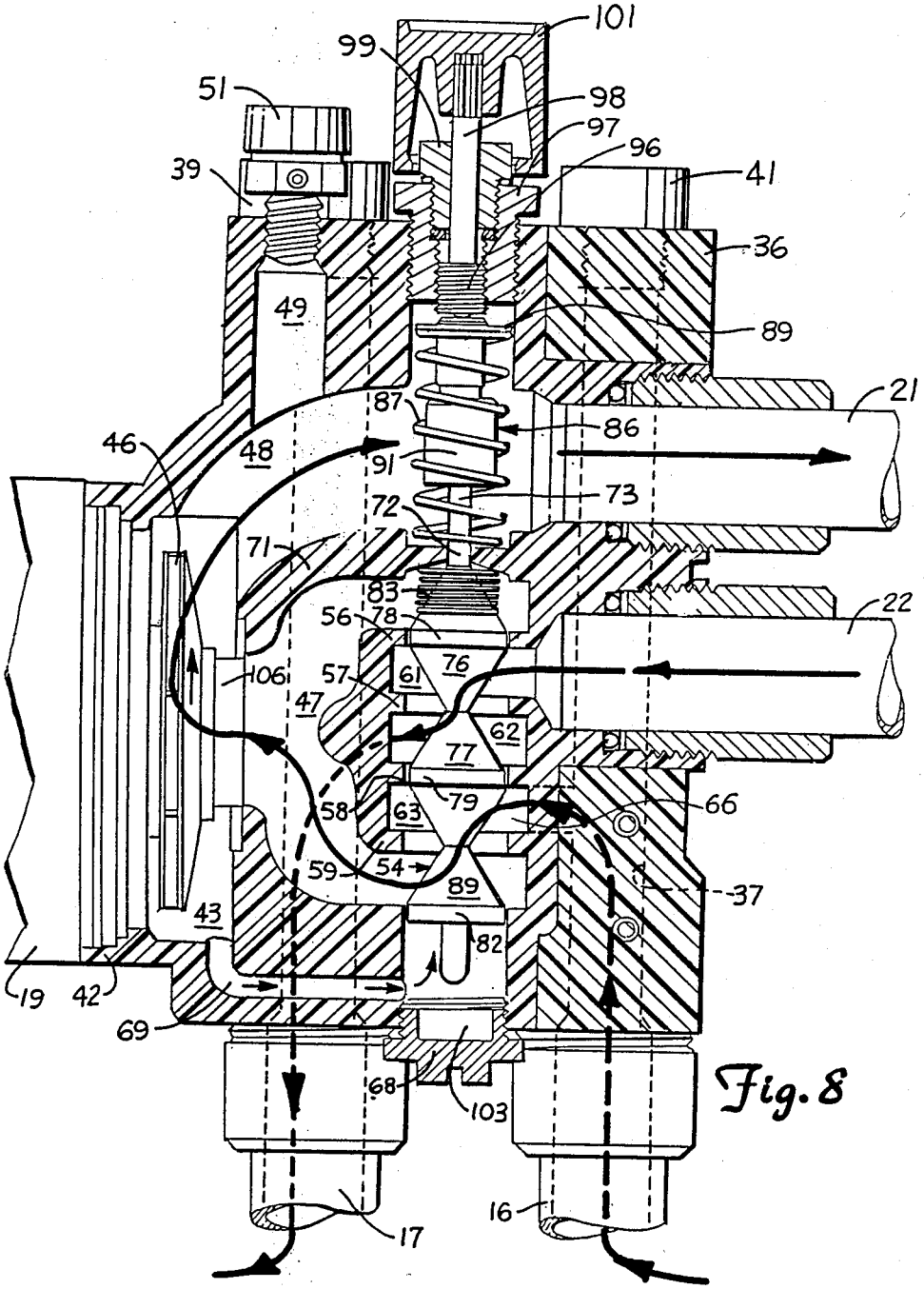
FIG. 8 is a sectional view similar to FIG. 4 showing the valve in the position to draw fluid from the heat source and direct the fluid through the heat transfer apparatus and return the fluid to the heat source.
Figure 9:
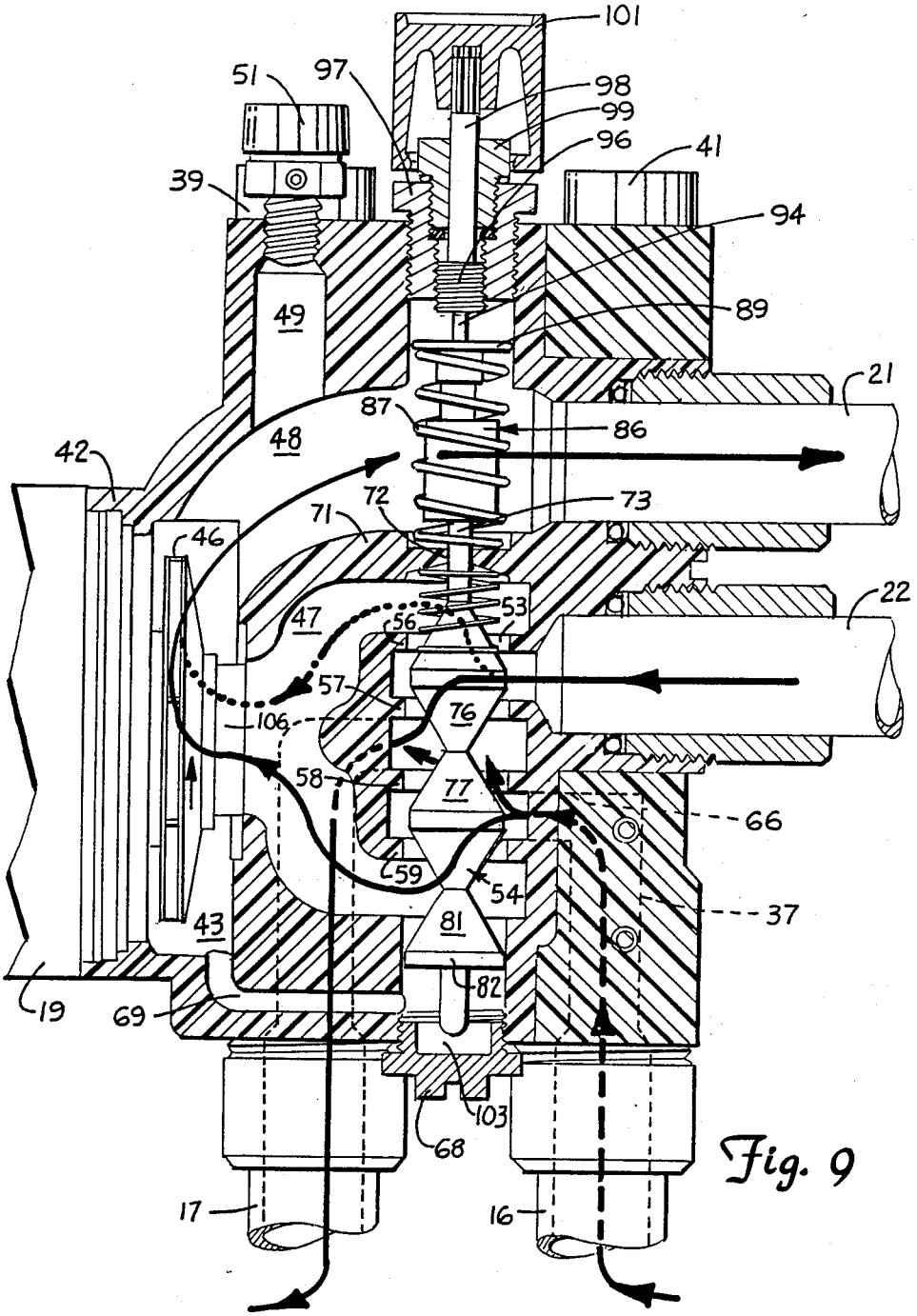
FIG. 9 is a sectional view similar to FIG. 4 showing the valve in a position to partially recirculate the fluid through the heat transfer apparatus and draw heated fluid from the heat source and recirculate fluid through the heat transfer apparatus and return fluid to the heat source.

On the operation of motor 19, impeller 46 will pump the fluid from pump chamber 43 into outlet chamber 48. Fluid will also be pumped into passage 69 whereby fluid under pressure will be supplied to chamber 103 below piston 81 of spool valve 54. The pressure of the fluid in chamber 103 will move spool valve 54 to its up or second position as shown in FIG. 8. Spring 83 is compressed and upper rod 73 is moved in engagement with the bottom of temperature responsive linear actuator 86. The second position of spool valve 54 is determined by stop 96. Stop 96 can be rotated to adjust its longitudinal position to thereby change the location of spool valve 54 relative to body 52. For example, when stop 96 is moved down, spool valve 54 will be in a lower location in body 52, as shown in FIG. 9. Each spool 76 and 77 will be located below annular ribs 56 and 58 whereby part of the return fluid from line 22 will recirculate into inlet chamber 47 and into return line 17. The ratio of recirculated and return fluid depends on the adjusted position of stop 96. This also adjusts the temperature of the fluid delivered by pump 19 to supply tube 21.

As shown in FIG. 8, the rim 78 of spool 76 is aligned with annular rib 56 whereby line 22 is open to fluid return passage 64. This allows fluid in line 22 to flow through valve 13 into return line 17 leading to the inlet of the fluid heating source apparatus 11.

Rim 79 of spool 77 is aligned with annular rib 58 whereby passage 66 is open to fluid inlet chamber 47. The hot fluid from fluid heating apparatus 11 is pumped by rotating impeller 46 into outlet passage 48 and inlet line 21 leading to heat transfer apparatus 12. The hot fluid in passage 48 flows around casing 91 of temperature responsive linear actuator 86. Heat is transferred through casing 91 to the wax and powder material 92. The material 92 expands causing piston 94 to move out of casing 91. This increases the overall length of the temperature responsive linear actuator 86. Piston 94 being engageable with fixed stop 96 causes casing 91 to move in a downward direction causing spool valve 54 to be moved from its second position shown in FIG. 8 toward its first position shown in FIG. 4. As spool valve 54 moves down, it reduces the amount of hot fluid that is pumped into the heat transfer apparatus 12 as shown in FIG. 9. Part of the hot fluid is recirculated into the heating apparatus 11. The double cone shaped spool 77 functions as a divider which directs part of the hot fluid into inlet passage 47 and part of the fluid to passage 64 leading to the fluid return passage 37. Spool 76 has been moved down from rib 56. The fluid flowing through return line 22 is divided by the double cone shaped spool 76. Part of the fluid is directed to return passage 64 and the remaining fluid is recirculated into the inlet passage 47 leading to the pump chamber 43.

The temperature of the fluid delivered to the heat transfer apparatus 12 is adjusted by adjusting the position of stop 96. Knob 101 is rotated whereby stop 96 linearly moves. This changes the position of spool 76 and 77 relative to valve passage 53. The amount of hot fluid that is directed into inlet passage 47 leading to pump chamber 43 is determined by the position of spool 77 relative to annular ribs 58 and 59 and the position of spool 76 relative to annular ribs 56 and 57. The ratio between the rates of flow of hot fluid into the pump chamber and the return fluid from line 22 into the return line 17 will simultaneously change at the same rate as the spool valve 54 is linearly moved in passage 53.

There has been shown and described a radiant floor heating system for a suspended floor. The heating system is usable with a slab on grade and other structures. Changes in the design and components of the heating apparatus, control apparatus, and heat transfer apparatus may be made by one skilled in the art without departing from the spirit of the invention or the scope of the appended claims. The invention is defined in the following claims.

What is claimed is:

1. A radiant heating system for heating a selected area comprising:

fluid heating means operable to heat a fluid, heat transfer means for accommodating heated fluid located in a selected area operable to allow heat to radiate to the environment adjacent the selected area, control means connected to the fluid heating means and heat transfer means for regulating the flow and temperature of the fluid to the heat transfer means, means to move fluid from the fluid heating means to the control means and return fluid from the control means to the fluid heating means, said control means having a pump for transferring fluid to the heat transfer means, a housing of material having a coefficient of thermal conductivity of less than 1.0 kcal/m h °C., a valve body defining a plurality of chambers within the housing, a valve movable within the valve body to control the recirculation of the return fluid from the heat transfer means back to the heat transfer means, and a temperature responsive actuator operable to control the position of the valve in response to the temperature of the fluid directed to the heat transfer means, thereby regulating the temperature of the fluid delivered to the heat transfer means, said housing having an internal passage, a pump in communication with the internal passage, and an outlet passage in communication with the pump chamber connected to heat transfer apparatus, said pump having rotatable means located in said pump chamber operable to pump fluid from the internal passage to the outlet passage, and wherein of said chambers a first valve chamber is connected to the heat transfer means to receive fluid therefrom, a second valve chamber is connected to the fluid heating means to receive heated fluid therefrom, and a third valve chamber is connected to the fluid heating means to return fluid thereto, all in response to the position of the valve in the valve body.

2. A radiant heating system for heating a selected area comprising:

fluid heating means operable to heat a fluid, heat transfer means for accommodating heated fluid located in a selected area operable to allow heat to radiate to the environment adjacent the selected area, control means connected to the fluid heating means and heat transfer means for regulating the flow and temperature of the fluid to the heat transfer means, means to move fluid from the fluid heating means to the control means and return fluid from the control means to the fluid heating means, said control means having a pump including rotatable means for transferring fluid to the heat transfer means, a housing of material having a coefficient of thermal conductivity of less than 1.0 kcal/m h °C., a valve body defining a plurality of chambers within the housing, a valve movable within the valve body to control the recirculation of the return fluid from the heat transfer means back to the heat transfer means, and a temperature responsive actuator operable to control the position of the valve in response to the temperature of the fluid directed to the heat transfer means, thereby regulating the temperature of the fluid delivered to the heat transfer means, said housing including a passage connecting the pump chamber with the valve passage whereby fluid under pressure caused by the rotatable means of the pump moves the valve from a first position wherein fluid is recirculated in the heat transfer means to a position wherein heated fluid from the fluid heating apparatus is pumped to the heat transfer means and fluid from the heat transfer means is returned to the fluid heating apparatus.

3. A radiant heating system for heating a selected area comprising:

fluid heating means operable to heat a fluid, heat transfer means for accommodating heated fluid located in a selected area operable to allow heat to radiate to the environment adjacent the selected area, control means connected to the fluid heating means and heat transfer means for regulating the flow and temperature of the fluid to the heat transfer means, means to move fluid from the fluid heating means to the control means and return fluid from the control means to the fluid heating means, said control means having a pump including rotatable means for transferring fluid to the heat transfer means, a housing of material having a coefficient of thermal conductivity of less than 1.0 kcal/m h °C., a valve body defining a plurality of chambers within the housing, a valve movable within the valve body to control the recirculation of the return fluid from the heat transfer means back to the heat transfer means, and a temperature responsive actuator operable to control the position of the valve in response to the temperature of the fluid directed to the heat transfer means, thereby regulating the temperature of the fluid delivered to the heat transfer means, said system including means to adjust the position of the actuator to thereby adjust the ratio of flow of fluid to the fluid heating apparatus and recirculation of fluid to the heat transfer apparatus.

4. A fluid flow control apparatus for a heating system comprising: a housing having an internal passage, a pump chamber in communication with the internal passage, an outlet passage in communication with the pump chamber connectable to a heat transfer apparatus, said pump having rotatable means located in said pump chamber operable to pump fluid from the internal passage to the outlet passage, said housing having a body located in said internal passage, said body having a longitudinal valve passage divided into first, second and third valve chambers, said first valve chamber being connectable to a heat transfer means to receive fluid therefrom, said second valve chamber being connectable to a fluid heating means to receive heated fluid therefrom, said third valve chamber being connectable to a fluid heating means to return fluid thereto, a valve located in said valve passage operable to control the flow of fluid to and from the fluid heating apparatus and recirculation of fluid from the heat transfer means back to the heat transfer means, and a temperature responsive actuator in cooperative engagement with the valve to control the ratio of flow of fluid to the fluid heating apparatus and recirculation of fluid to the heat transfer apparatus.

5. The apparatus of claim 4 including: a passage in the housing connecting the pump chamber with the valve passage whereby fluid under pressure caused by the rotatable means of the pump moves the valve from a first position wherein fluid is recirculated in the heat transfer means to a second position wherein heated fluid from the fluid heating apparatus is pumped to the heat transfer means and fluid from the heat transfer means is returned to the fluid heating apparatus.

6. The apparatus of claim 5 including: biasing means for biasing the valve to said first position.

7. The apparatus of claim 4 including: means to adjust the position of the actuator thereby adjust the ratio of flow of fluid to the fluid heating apparatus and recirculation of fluid to the heat transfer apparatus.

8. The heating system of claim 2 including biasing means for biasing the valve to said first position.

* * * * *